US007530504B1

(12) United States Patent
Danner et al.

(10) Patent No.: US 7,530,504 B1
(45) Date of Patent: May 12, 2009

(54) CLUTCH FOR ROTOR-TYPE SPRINKLER

(75) Inventors: Fred M. Danner, Vista, CA (US); Ronald H. Anuskiewicz, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 0 days.

(21) Appl. No.: 11/846,430

(22) Filed: Aug. 28, 2007

Related U.S. Application Data

(63) Continuation-in-part of application No. 11/376,440, filed on Mar. 15, 2006, now abandoned.

(51) Int. Cl.
*B05B 3/04* (2006.01)
*B05B 15/10* (2006.01)
*B05B 3/00* (2006.01)

(52) U.S. Cl. ..... 239/240; 239/203; 239/204; 239/206; 239/263.3

(58) Field of Classification Search ..... 239/200, 239/201, 203–206, 225.1, 237, 240, 241, 239/252, 263, 263.3, DIG. 1
See application file for complete search history.

(56) References Cited

U.S. PATENT DOCUMENTS

| | | | | |
|---|---|---|---|---|
| 3,107,056 | A | 10/1963 | Hunter | |
| 3,934,820 | A | 1/1976 | Phaup | 239/205 |
| 4,568,024 | A | 2/1986 | Hunter | 239/242 |
| 4,625,914 | A | 12/1986 | Secton et al. | 239/206 |
| 4,718,605 | A | 1/1988 | Hunter | 239/242 |
| 4,892,252 | A | 1/1990 | Bruninga | 239/205 |
| 4,901,924 | A | 2/1990 | Kah, Jr. | 239/242 |
| 5,048,757 | A * | 9/1991 | Van Leeuwen | 239/205 |
| 5,148,991 | A | 9/1992 | Kah, Jr. | 239/242 |
| 5,383,600 | A | 1/1995 | Verbera et al. | 239/205 |
| 5,673,855 | A | 10/1997 | Nguyen et al. | 239/241 |
| 5,676,315 | A | 10/1997 | Han | 239/590 |
| 5,695,123 | A | 12/1997 | Le | 239/259 |
| 5,758,827 | A | 6/1998 | Van Le et al. | 239/242 |
| 6,042,021 | A * | 3/2000 | Clark | 239/205 |
| 6,050,502 | A | 4/2000 | Clark | 239/237 |
| 6,732,950 | B2 | 5/2004 | Ingham, Jr. et al. | 239/205 |
| 6,840,460 | B2 | 1/2005 | Clark | 239/205 |
| 6,945,471 | B2 | 9/2005 | McKenzie et al. | 239/237 |
| 7,040,553 | B2 | 5/2006 | Clark | 239/263.3 |
| 2006/0049275 | A1 | 3/2006 | Santiago et al. | 239/240 |
| 2006/0108446 | A1 | 5/2006 | Yeh et al. | 239/240 |

OTHER PUBLICATIONS

Declaration of Fred M. Danner in re U.S. Appl. No. 11/625,206 and Exhibits A-F as referenced therein.

* cited by examiner

*Primary Examiner*—Darren W Gorman
(74) *Attorney, Agent, or Firm*—Michael H. Jester

(57) ABSTRACT

A sprinkler includes a riser, an impeller mounted in the riser, and a nozzle rotatably mounted at an upper end of the riser. A drive assembly couples the impeller and the nozzle. A clutch in the drive assembly includes a radially deformable collet that surrounds a drive shaft. A spring urges the collet against the drive shaft and provides a positive drive connection under a normal load and slips under an excessive load.

27 Claims, 4 Drawing Sheets

CLUTCH FOR ROTOR-TYPE SPRINKLER

CROSS-REFERENCE TO RELATED APPLICATION

This application is a continuation-in-part of pending U.S. patent application Ser. No. 11/376,440 Filed Mar. 15, 2006. This application claims priority based on the filing said Ser. No. 11/376,440 application under 35 U.S.C. Sections 119 and 120.

FIELD OF THE INVENTION

The present invention relates to sprinklers used to irrigate turf and landscaping, and more particularly, to clutch mechanisms designed to prevent drive assembly damage when vandals twist the nozzle turret of a rotor-type sprinkler.

BACKGROUND OF THE INVENTION

A common type of irrigation sprinkler used to water turf and landscaping is referred to as a rotor-type sprinkler. It typically includes a riser that telescopes from an outer casing. The riser encloses a turbine that rotates a nozzle turret at the top of the riser through a reduction gear train and reversing mechanism. Typically the nozzle turret oscillates back and forth through an arc whose size can be adjusted depending on the area of coverage required. Vandals frequently twist the nozzle turret of rotor-type sprinklers which causes them to spray water outside their intended arc of coverage, often onto roads and sidewalks. When a vandal twists the nozzle turret of a rotor-type sprinkler to "back drive" the sprinkler, i.e. rotate the nozzle turret in a direction opposite the direction it is currently being driven by its turbine, strong rotational forces are transmitted to the reversing mechanism and reduction gear train, frequently damaging the same.

Rotor-type sprinklers often include some form of clutch that slips when the nozzle turret is rotated by an external force, i.e. one not generated by the turbine. A clutch in a rotor-type sprinkler must be able to transmit a steady rotational drive force to the nozzle turret so that the turbine can rotate the nozzle turret back and forth between the pre-set arc limits, or in some cases, rotate the nozzle turret continuously through three hundred and sixty degrees. However the clutch must be capable of breaking loose or disengaging when the nozzle turret is twisted by a vandal.

Rotor-type sprinklers have also been developed that include an automatic arc return mechanism so that the nozzle turret can be twisted out of arc by a vandal, and will resume oscillation within the intended arc of coverage without any resulting damage to the reduction gear train or reversing mechanism. See for example U.S. Pat. No. 6,050,502 granted to Clark on Apr. 18, 2000 and U.S. Pat. No. 6,840,460 granted to Clark on Jan. 11, 2005, both assigned to Hunter Industries, Inc., the assignee of the subject application.

Clutches and automatic arc return mechanisms that have heretofore been developed for rotor-type sprinklers have been too complex, required too many parts and/or been too unreliable. They have also not been suitable for retrofitting, i.e. installation into existing rotor-type sprinklers not originally designed with suitable clutches.

SUMMARY OF THE INVENTION

In accordance with an embodiment of the invention, a sprinkler includes a riser, an impeller mounted in the riser, and a nozzle rotatably mounted at an upper end of the riser. A drive assembly couples the impeller and the nozzle. A clutch in the drive assembly includes a radially deformable collet that surrounds a drive shaft and provides a positive drive connection under a normal load and slips under an excessive load.

DETAILED DESCRIPTION

The entire disclosures of U.S. Pat. No. 3,107,056 granted to Hunter on Oct. 15, 1963; U.S. Pat. No. 4,568,024 granted to Hunter on Feb. 4, 1986; U.S. Pat. No. 4,718,605 granted to Hunter on Jan. 12, 1988; U.S. Pat. No. 6,050,502 granted to Clark on Apr. 18, 2000; U.S. Pat. No. 6,840,460 granted to Clark on Jan. 11, 2005; and pending U.S. patent application Ser. No. 11/139,725 filed by Crooks on May 27, 2005, are hereby incorporated by reference.

Figure 1:
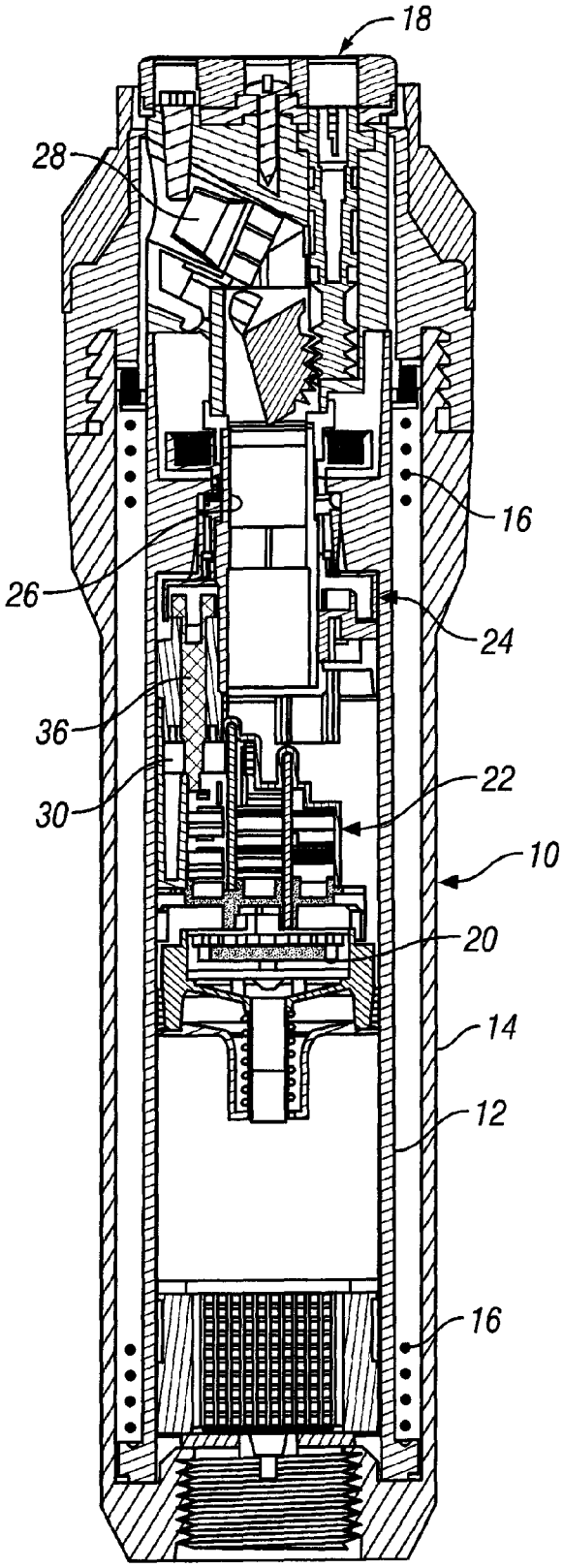
FIG. 1 is a vertical sectional view of a rotor-type sprinkler in accordance with an embodiment of the invention.

Referring to FIG. 1, in accordance with an embodiment of the invention, a rotor-type sprinkler 10 includes a tubular riser 12 vertically reciprocable within an outer case 14 and normally held in a retracted position by a coil spring illustrated diagrammatically by dots 16. A cylindrical nozzle head or turret 18 is rotatably mounted at the upper end of the riser 12. A turbine 20, reduction gear train 22, and a reversing mechanism 24 are mounted in the riser 12 and rotate the nozzle turret 18 through an adjustable arc, as well known in the art. Besides the turbine 20, other impellers may be used, such as ball drives, swirl plates, and so forth. See for example U.S. Pat. No. 4,625,914 granted to Sexton et al. on Dec. 2, 1986.

Figure 2:
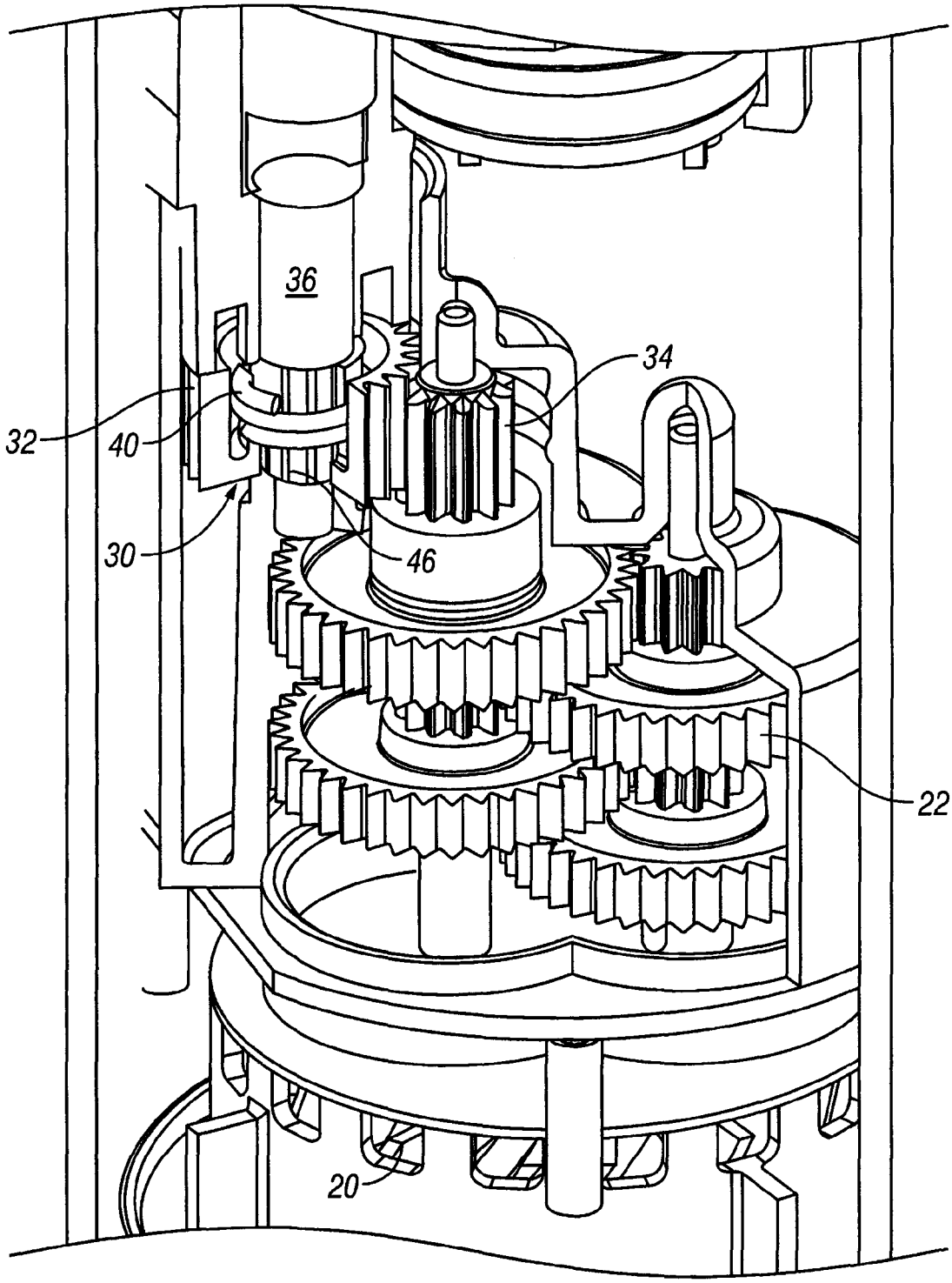
FIG. 2 is an enlarged fragmentary isometric view of the reduction gear train and clutch of the sprinkler of FIG. 1.
Figure 3:
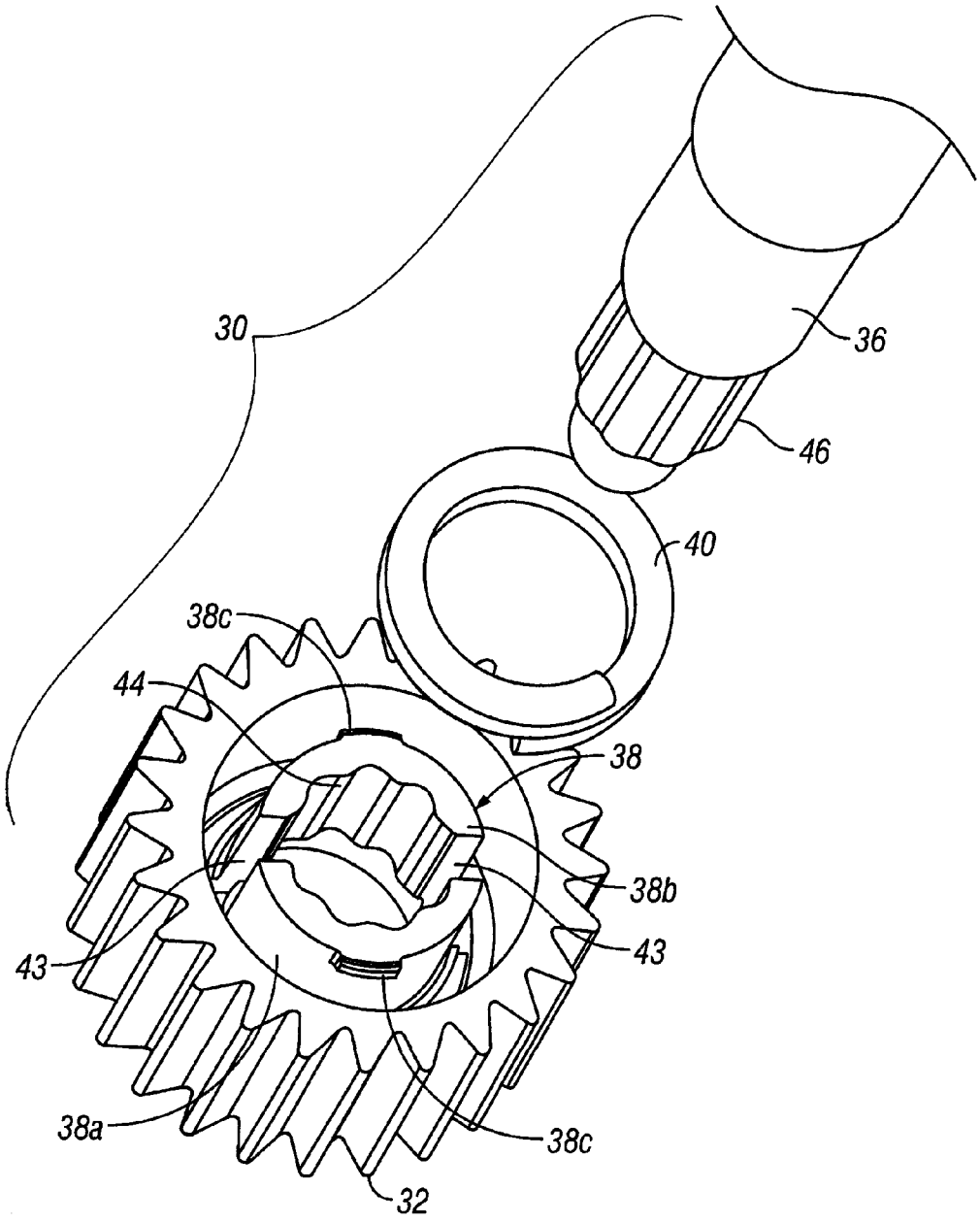
FIG. 3 is a still further enlarged exploded isometric view of the clutch of the sprinkler of FIG. 1.

Together the reduction gear train 22 and reversing mechanism 24 form a drive assembly coupling the turbine 20 and the nozzle turret 18 via a relatively large hollow tubular shaft 26. Water flows through the turbine 20, through the shaft 26 and exits through a replaceable nozzle 28 mounted in the nozzle turret 18. A clutch 30 is provided in the drive assembly inside of a spur gear 32 (FIG. 3) between a final output gear 34 (FIG. 2) of the reduction gear train 22 and a drive shaft 36 (FIG. 1) connected to the reversing mechanism 24. The clutch 30 provides a positive drive connection under a normal load and slips under an excessive externally applied load such as that which occurs when a vandal twists the nozzle turret 18.

Figure 4:
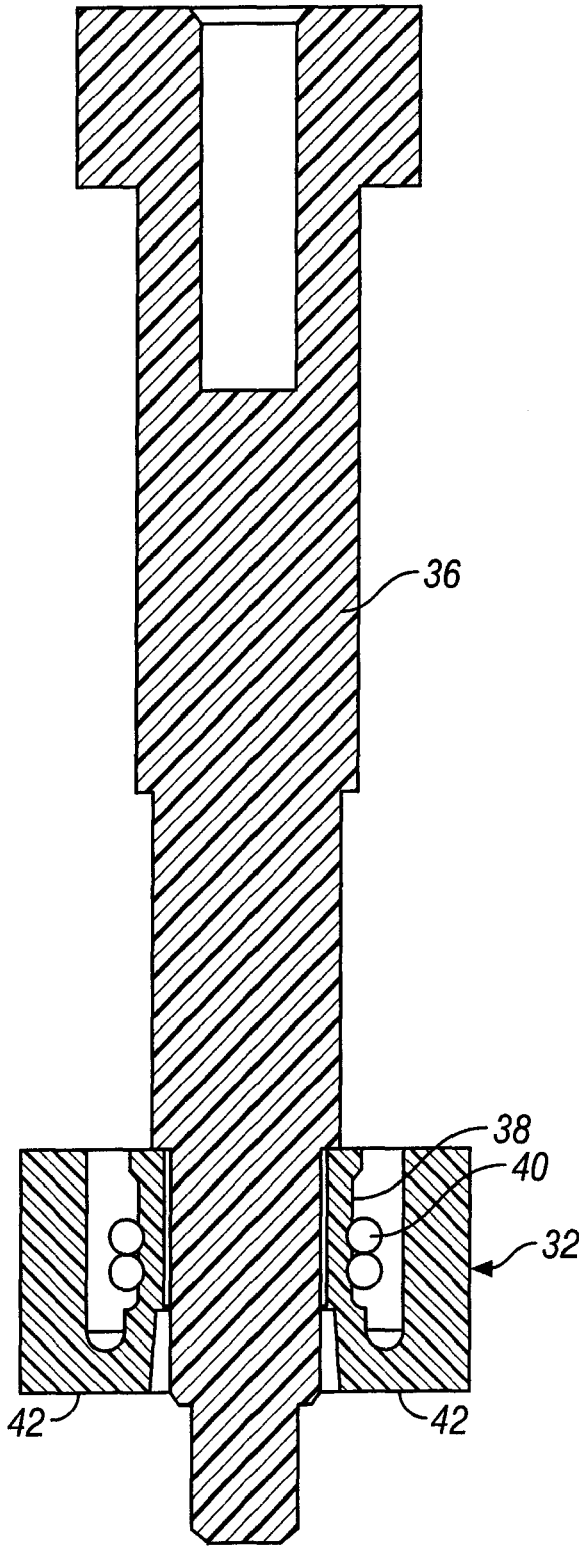
FIG. 4 is a cross-section view of the assembled clutch of FIG. 3.

The clutch 30 includes a radially deformable collet 38 (FIG. 3) that surrounding the drive shaft 36 and a metal coil spring 40 that urges the collet 38 against the drive shaft 36. The collet 38 is a split ring integrally formed in the center of the spur gear 32 and connected thereto by a radial extension 42 (FIG. 4). The spur gear 32 and collet may be formed by injection molding suitable plastic. The split ring of the collet 38 has a pair of diametrically opposed gaps 43 (FIG. 3) that create two fingers 38*a* and 38*b*. These fingers are biased radially inwardly under the force of the coil spring 40. The outer surface of the collet 38 is smooth so that the coil spring 40 can be slid downwardly over the same during assembly. During assembly of the clutch 30, before the shaft 36 is inserted through the spur gear 32, the fingers 38*a* and 38*b* can be squeezed inwardly to facilitate sliding of the spring 40 over the same. The fingers 38*a* and 38*b* are formed with a radial projection 38*c* that retain the spring 40 and prevent it from inadvertently popping off of the fingers 38*a* and 38*b* when they flex radially outwardly during operation of the clutch 30. If the spring 40 were to inadvertently slip off the collet 38, depending upon the resiliency of the fingers 38*a* and 38*b*, the collet 38 might fail to have sufficient gripping force to permit the turbine 20 to drive the nozzle turret 18.

The collet 38 has internal teeth 44 (FIG. 3) that engage external teeth 46 on the drive shaft 36 in non-slip fashion under a normal internally generated load and disengage and allow slippage under an excessive externally generated load. Both the collet 38 and the drive shaft 36 preferably have a tooth pattern with a specific angle on the teeth so that the clutch 30 holds and slips at predetermined rotational force levels. In the illustrated embodiment, the internal teeth 44 are formed by adjacent concave recesses. The external teeth 46 are formed by adjacent convex projections. This scalloped tooth pattern for the collet 38 and drive shaft 36 are preferable to standard V-shaped gear teeth. This is because, over time, V-shaped gear teeth would wear and become rounded from slippage to a point where the clutch would no longer hold under a normal drive load. The scalloped tooth pattern affords smooth or rounded contact surfaces that are far less likely to wear over time and change the gripping force of the collet 38.

The clutch 30 holds under a normal level of rotational force generated internally by the turbine 20. The clutch 30 slips under an excessive level of rotational force generated externally by a vandal twisting the nozzle turret. The fingers of the collet 38 formed by its spit ring configuration are banded by the coil spring 40 that maintains the correct load on the drive shaft 36 over long periods of time. The coil spring 40 works in concert with the specific angles and shapes of internal the teeth 44 on the collet 38 and the external teeth 46 on the drive shaft 36 to provide accurate disengagement and hold points. Under and excessive load, the coil spring 40 allows the fingers of the collet 38 to deflect radially outwardly to thereby allow the internal teeth 44 to disengage with the external teeth 46 and slip past the same to permit relatively rotational movement between the spur gear 32 and the drive shaft 36.

The clutch 30 provides accurate control between the drive load and the breakaway load. It is relatively small and can be retrofitted into many existing rotor-type sprinklers by simply replacing the final spur gear of the reduction gear train 22. The clutch 30 is durable, reliable, and readily manufactured and assembled. The clutch 30 is located lower in the drive assembly than conventional clutches in rotor-type sprinklers. Many conventional rotor-type sprinklers associate the clutch with the relatively large hollow tubular shaft 26. The location of the clutch 30 between the reduction gear train 22 and reversing mechanism 24 subjects the clutch 30 to lower forces, allowing it to be smaller than clutches associated with the tubular drive shaft 26. Therefore the clutch 30 can be smaller and the hold and breakaway force levels can be more easily controlled.

The sprinkler 10 can operate as full-circle, continuous three hundred and sixty degree rotation, rotor-type sprinkler. It may be constructed so that its nozzle 28 can optionally oscillate between pre-selected arc limits or rotated continuously in a uni-directional manner. See pending U.S. patent application Ser. Nos. 11/139,725 filed May 25, 2005 and 11/612,801 filed Dec. 19, 2006, of John D. Crooks, the entire disclosures of which are hereby incorporated by reference. The slip-clutch of the present invention can also be used in a rotor-type sprinkler that can only operate in full circle mode, i.e. the sprinkler has no reversing mechanism. When in a full circle mode, the nozzle turret 18 of either sprinkler may be rotated by a vandal in the same direction as the current direction of rotation of the nozzle 28. The load is taken off the drive assembly and the slip-clutch 30 does not slip. However, when the turret 18 is rotated by the vandal in the direction that is the reverse of the direction that is currently being driven by the turbine 20, the clutch 30 slips under excessive load to prevent damage to the reversing mechanism 24 and reduction gear train 22.

While we have described an embodiment of our invention, modifications and adaptations thereof will occur to those skilled in the art. For example, the coil spring 40 could be replaced with an O-ring or other elastomeric spring, or could be eliminated completely if the fingers of the collet 38 provide sufficient spring force based on their own resiliency determined by their shape, thickness, configuration and material. Therefore, the protection afforded our invention should only be limited in accordance with the scope of the following claims.

We claim:

1. A sprinkler, comprising:

a riser;

an impeller mounted in the riser;

a nozzle rotatably mounted at an upper end of the riser;

a drive assembly coupling the impeller and the nozzle; and a clutch in the drive assembly including a radially deformable collet surrounding a drive shaft that provides a positive drive connection under a normal load and slips under an excessive load and wherein the collet includes a split ring that defines radially deformable fingers and a spring that urges the fingers of the collet against the drive shaft.

2. The sprinkler of claim 1 wherein the collet has internal teeth that engage external teeth on the drive shaft in non-slip fashion under the normal load and disengage and allow slippage under the excessive load.

3. The sprinkler of claim 1 wherein the collet is positioned internally of a spur gear.

4. The sprinkler of claim 1 wherein the collet is integrally formed as part of a spur gear.

5. The sprinkler of claim 3 wherein the spur gear is engaged with a final gear of a reduction gear train of the drive assembly.

6. The sprinkler of claim 1 wherein the shaft is coupled to a reversing mechanism of the drive assembly.

7. The sprinkler of claim 1 wherein the collet is integrally formed as part of a spur gear that is engaged with a final gear of a reduction gear train of the drive assembly and the shaft is coupled to a reversing mechanism of the drive assembly.

8. The sprinkler of claim 6 wherein the collet has internal teeth that engage external teeth on the drive shaft in non-slip fashion under the normal load and disengage and allow slippage under the excessive load.

9. A sprinkler, comprising:

a riser;

an impeller mounted in the riser;

a nozzle rotatably mounted at an upper end of the riser;

a drive assembly coupling the impeller and the nozzle; and a clutch in the drive assembly inside of a spur gear between an output gear of a reduction gear train in the drive assembly and a drive shaft connected to a reversing mechanism of the drive assembly that provides a positive drive connection under a normal load and for slips under an excessive load and wherein the clutch includes a radially deformable collet surrounding the drive shaft and a spring that urges the collet against the drive shaft.

10. The sprinkler of claim 9 wherein the collet includes a split ring.

11. The sprinkler of claim 9 wherein the collet has internal teeth that engage external teeth on the drive shaft in non-slip fashion under the normal load and disengage and allow slippage under the excessive load.

12. The sprinkler of claim 9 wherein the collet is integrally formed as part of the spur gear.

13. The sprinkler of claim 9 wherein the spring is a coil spring.

14. The sprinkler of claim 10 wherein the split ring has two gaps.

15. The sprinkler of claim 9 wherein the collet has a smooth outer surface.

16. A clutch, comprising:

a radially deformable collet in the form of a split ring integrally formed inside a spur gear and dimensioned for surrounding a drive shaft with external teeth, a spring surrounding the collet for urging the collet against the drive shaft, the collet having internal teeth that engage the external teeth on the drive shaft in non-slip fashion under a normal load and disengage and allow slippage under an excessive load.

17. A sprinkler, comprising:

a riser;

a turbine mounted in the riser;

a nozzle turret rotatably mounted at an upper end of the riser;

a drive assembly coupling the turbine and the nozzle turret; and a clutch in the drive assembly including a radially deformable split ring surrounding a drive shaft, the split ring being integrally formed in the center of a spur gear, the split ring having internal teeth that engage external teeth on the shaft, and a spring that urges the split ring against the drive shaft to engage the internal and external teeth under a normal load and disengage the internal and external teeth under an excessive load and allow slippage.

18. A sprinkler, comprising:

a riser;

an impeller mounted in the riser;

a nozzle rotatably mounted at an upper end of the riser;

a drive assembly coupling the impeller and the nozzle; and a clutch in the drive assembly including a radially deformable collet surrounding a drive shaft and a spring that urges the collet against the drive shaft for providing a positive drive connection under a normal load and for slipping under an excessive load.

19. The sprinkler of claim 18 wherein the collet includes a split ring.

20. The sprinkler of claim 18 wherein the collet has internal teeth that engage external teeth on the drive shaft in non-slip fashion under the normal load and disengage and allow slippage under the excessive load.

21. The sprinkler of claim 18 wherein the collet is coupled to a spur gear.

22. The sprinkler of claim 18 wherein the collet is integrally formed as part of a spur gear.

23. The sprinkler of claim 21 wherein the spur gear is engaged with a final gear of a reduction gear train of the drive assembly.

24. The sprinkler of claim 18 wherein the shaft is coupled to a reversing mechanism of the drive assembly.

25. The sprinkler of claim 18 wherein the collet is integrally formed as part of a spur gear that is engaged with a final gear of a reduction gear train of the drive assembly and the shaft is coupled to a reversing mechanism of the drive assembly.

26. The sprinkler of claim 25 wherein the collet has internal rounded teeth that engage external rounded teeth on the drive shaft in non-slip fashion under the normal load and disengage and allow slippage under the excessive load.

27. The sprinkler of claim 26 wherein the collet includes a split ring.

* * * * *